United States Patent [19]

Suzuki et al.

[11] Patent Number: 4,529,017

[45] Date of Patent: Jul. 16, 1985

[54] APPARATUS FOR MEASURING THE LENGTH OF WEFT YARN FOR A LOOM

[75] Inventors: Hajime Suzuki, Anjo; Masao Shiraki, Toyota, both of Japan

[73] Assignee: Kabushiki Kaisha Toyoda Jidoshokki Seisakusho, Kariya, Japan

[21] Appl. No.: 523,724

[22] Filed: Aug. 16, 1983

[30] Foreign Application Priority Data

Aug. 21, 1982 [JP] Japan ..... 57-145361
Dec. 14, 1982 [JP] Japan ..... 57-218861

[51] Int. Cl.[3] ..... D03D 47/36
[52] U.S. Cl. ..... 139/452; 242/47.01
[58] Field of Search ..... 139/452, 435; 242/47.01, 47 R; 66/132 R

[56] References Cited

U.S. PATENT DOCUMENTS

| | | | |
|---|---|---|---|
| 3,796,386 | 3/1974 | Tannert | 242/47.01 |
| 4,372,349 | 2/1983 | Van Mullekom | 139/452 |
| 4,397,340 | 8/1983 | Umezawa et al. | 139/452 |
| 4,407,336 | 10/1983 | Steiner | 139/452 |

*Primary Examiner*—James Kee Chi

*Attorney, Agent, or Firm*—Brooks, Haidt, Haffner & Delahunty

[57] ABSTRACT

An apparatus for measuring the weft yarn length for a loom constructed in accordance with the present invention comprises at least two weft yarn supply units each having a weft yarn length measurement element presenting a yarn winding surface, an equal number of electric motors each adapted for winding weft yarn around said yarn winding surface of the measurement element, and weft yarn latching mechanisms for controlling the amount of the weft yarn wound on each winding surface and the transfer of the wound yarn in the weft inserting direction. Each of the rotational speeds of the respective motors and the operation of the respective weft yarn latching mechanisms may be controlled by a control unit in accordance with a preset weft yarn selection program.

Each yarn length measurement element may be associated with a sensor for sensing the number of times the weft yarn is wound on the element. Sensor signals are introduced into the control means from said sensors and speed commands are outputted from said control means to respective motors for compensating for any fluctuations that may be caused in the measured lengths of the weft yarn.

9 Claims, 4 Drawing Figures

APPARATUS FOR MEASURING THE LENGTH OF WEFT YARN FOR A LOOM

BACKGROUND OF THE INVENTION

This invention relates to an apparatus for measuring the length of weft yarn for a loom, in which the weft yarn supplied from the weft yarn supply unit is wound on a winding surface for length measurement and the weft yarn whose length has been measured is stored provisionally in the wound state so as to be pulled out at the time of subsequent weft insertion.

In a shuttleless loom in general, and particularly in a jet loom, an apparatus is provided for measuring a length.of weft yarn corresponding to one weft inserting operation and provisionally storing the measured length of weft yarn. According to the apparatus of this type so far proposed in the art, the weft yarn supplied from the weft yarn supply unit is wound for length measurement and the weft yarn whose length has been measured is provisionally stored in the wound state so as to be subsequently pulled out for weft insertion.

With this winding type apparatus, the weft yarn is wound on the yarn winding surface of a yarn length measurement element such as drum, and the length of the weft yarn wound on said surface as well as transfer thereof in the weft yarn inserting direction is controlled by at least a pair of weft yarn latching pins adapted for emerging from and receding into the inside of the yarn winding surface. The weft yarn is usually passed through a yarn supply pipe adapted for rotation relative to the measurement element, and is wound on the winding surface of the element.

It is to be noted that, when only one kind of weft yarn is supplied from only one supply source and inserted for forming a woven cloth, only one weft yarn length measurement unit will serve the purpose. However, when the weft yarns are supplied from two or more supply units, it is necessary to provide a number of weft yarn length measurement units equal to the number of said supply units. For example, when two weft yarns are supplied alternately from two weft yarn supply units, two measurement units are used. In this case, the supply speed of each weft yarn or the winding speed of each weft yarn on the measurement element of each unit is one half the winding speed for the case of using only one measurement unit (hereafter referred to as usual winding speed) so that the length of each weft yarn is measured once per two weft inserting operations, with the weft yarns being laid down or inserted alternately. This type of weft insertion is resorted to not only when supplying two weft yarns of different color but when supplying the same kind of weft yarn from two weft yarn supply units with a view to realizing a cloth of uniform quality consisting of one kind of weft yarn. The art of supplying the same kind of weft yarns from plural weft yarn supply units is known as mixing.

The aforementioned pattern of weft insertion may be applied to cases where three or more weft supply units are used. Thus, when three weft yarn supply units are used, the winding speed of each yarn is one third the usual winding speed, and a length of each weft yarn corresponding to one weft insertion (hereafter referred to as preset length) is measured per three weft inserting operations with the thus measured lengths of the three weft yarns being laid down successively. When there are four weft yarn supply units, the winding speed of each weft yarn is one fourth the usual winding speed and a length of each weft yarn equal to the preset length is measured per four weft inserting operations with the measured lengths of the weft yarns being inserted or laid down successively. The same applies to the case five or more weft yarn supply units are used. This type of weft yarn insertion is effective in cases where the weft yarns supplied from the respective weft yarn supply units are different and laid down alternately, or where the aforementioned mixing is performed for realizing a cloth of uniform quality. However, when the weft yarns of two or more kinds are used and the weft yarn lengths of the same kind are inserted successively a certain number of times, it would be necessary to provide a number of weft yarn length measurement units at least equal to said number of times for the weft yarn.

In order to avoid this deficiency, an apparatus for measuring weft yarn length has been proposed in which, in addition to the weft yarn latching pin provided to the conventional apparatus, an auxiliary latching pin is provided closer to the woven cloth than the aforementioned latching pin for controlling the transfer of the measured yarn in the weft inserting direction, thereby enabling the weft yarn of the same kind to be inserted a certain number of times in succession (Japanese Laid-open Patent Specification No. 79740/1981). In this apparatus, the weft yarns supplied from the two weft yarn supply units are wound on the winding surfaces of the respective weft yarn length measurement units at respective constant speeds. For instance, when one of the weft yarns is inserted twice in succession, after which the other yarn is inserted once, the winding speed for the former yarn is equal to two-thirds the usual winding speed, while that of the remaining weft yarn is one-third the usual winding speed.

In this pattern of weft insertion, it is assumed that, the instant one weft yarn has been released from the auxiliary latching pin and laid down, one third the preset length of the same weft yarn is latched by the latching pin on the winding surface, and that one third the preset length of the other weft yarn is latched by the associated latching pin on the associated winding surface. At the instant of the next insertion, the preset length of the former yarn is latched by the associated latching pin on the winding surface, this length of yarn being released from the latching pins and laid down. At this time, two thirds the preset length of the latter yarn is wound on the associated winding surface. At the instant of the next weft insertion, the length of the latter yarn is increased to a value necessary for one weft insertion (preset length), this length of the other yarn being then released from the latching pins and laid down. At this time, two thirds the preset length of the former yarn is stored. At the next weft insertion, a length of the former yarn necessary for the next insertion (preset length) is latched on the winding surface by the auxiliary latching pin, and one third the preset length of the same yarn is latched by the latching pins on the same winding surface. From this it follows that only one auxiliary latching pin need be provided to the length measurement unit associated with said former yarn.

When the two yarns are inserted alternately so that the same yarn is inserted twice successively, one auxiliary latching pin may be provided on each measurement unit. In this case, the winding speed for each weft yarn is equal to one half the usual winding speed.

However, in instances where the same yarn supplied from one supply unit is inserted a number of times successively, it becomes necessary to provide a plurality of said auxiliary latching pins to the measurement unit allocated to said weft yarn. For instance, supposing that one weft yarn is inserted four times successively, after which the other weft yarn is inserted thrice successively, with the winding speed for said one weft being four-sevenths of the usual speed and the winding speed for said other weft yarn being three-sevenths of the usual speed, said one weft yarn need be wound in an amount at least equal to two and two-sevenths times the preset length at the time that said one weft yarn starts to be inserted successively. This is because the length of said one yarn on the winding surface is reduced in this case to one and six-sevenths time the preset length for the second insertion, to one and three-seventh the preset length for the third insertion and to equal to said preset length for the fourth insertion. Thus a yarn length corresponding to two weft inserting operations and another yarn length corresponding to the following two weft inserting operations need be stored by two separate pairs of the auxiliary latching pins at the time that said one yarn starts to be inserted successively.

The necessity for increasing the number of auxiliary latching pins with increases in the number of times the weft yarn supplied from one supply source is inserted successively is not desirable because it gives rise to a complicated structure of the apparatus for measurement of the weft yarn. Furthermore, the above deficiency may not be removed insofar as the weft yarn is wound successively.

Thus, a demand has existed for a weft yarn length measurement apparatus whereby the weft yarn to be inserted may be freely selected without the necessity of changing mechanical parts.

SUMMARY OF THE INVENTION

An apparatus for measuring the weft yarn length for a loom constructed in accordance with the present invention comprises at least two weft yarn supply units each having a weft yarn length measurement element presenting a yarn winding surface, at least two electric motors each adapted for winding weft yarn around the yarn winding surface of the measurement element, and weft yarn latching means for controlling the amount of weft yarn wound on the winding surfaces and the transfer of the wound yarn in the weft inserting direction. The rotational speeds of the electric motors and the operation of the respective weft yarn latching means may be controlled by control means in accordance with a preset weft yarn selection program. The rotational speed of the electric motors and the operative timing of the respective weft yarn latching means may be changed by changing the weft yarn selection program and thus without the necessity of changing mechanical parts for realizing a great variety in the weft yarn patterns.

The rotational speeds of the motors may probably not be controlled in the manner specified by the weft yarn selection program due to such reasons as rotational resistance or unstable braking properties, with resultant fluctuations in the measured lengths of the weft yarn.

Therefore, according to a preferred embodiment of the present invention, the weft yarn length measurement element is operatively associated with sensor means adapted for sensing the number of times the weft yarn is wound on the element. Output signals from said sensor means are introduced into the control means from said sensor means, and speed commands are outputted from said control means to respective electric motors for compensating for any fluctuations that may be caused in the measured lengths of the weft yarn.

BRIEF DESCRIPTION OF THE DRAWINGS

This invention will become more readily apparent from the following description of preferred embodiments shown, by way of example only, in the accompanying drawings, in which.

DESCRIPTION OF THE PREFERRED EMBODIMENTS

Figure 1:
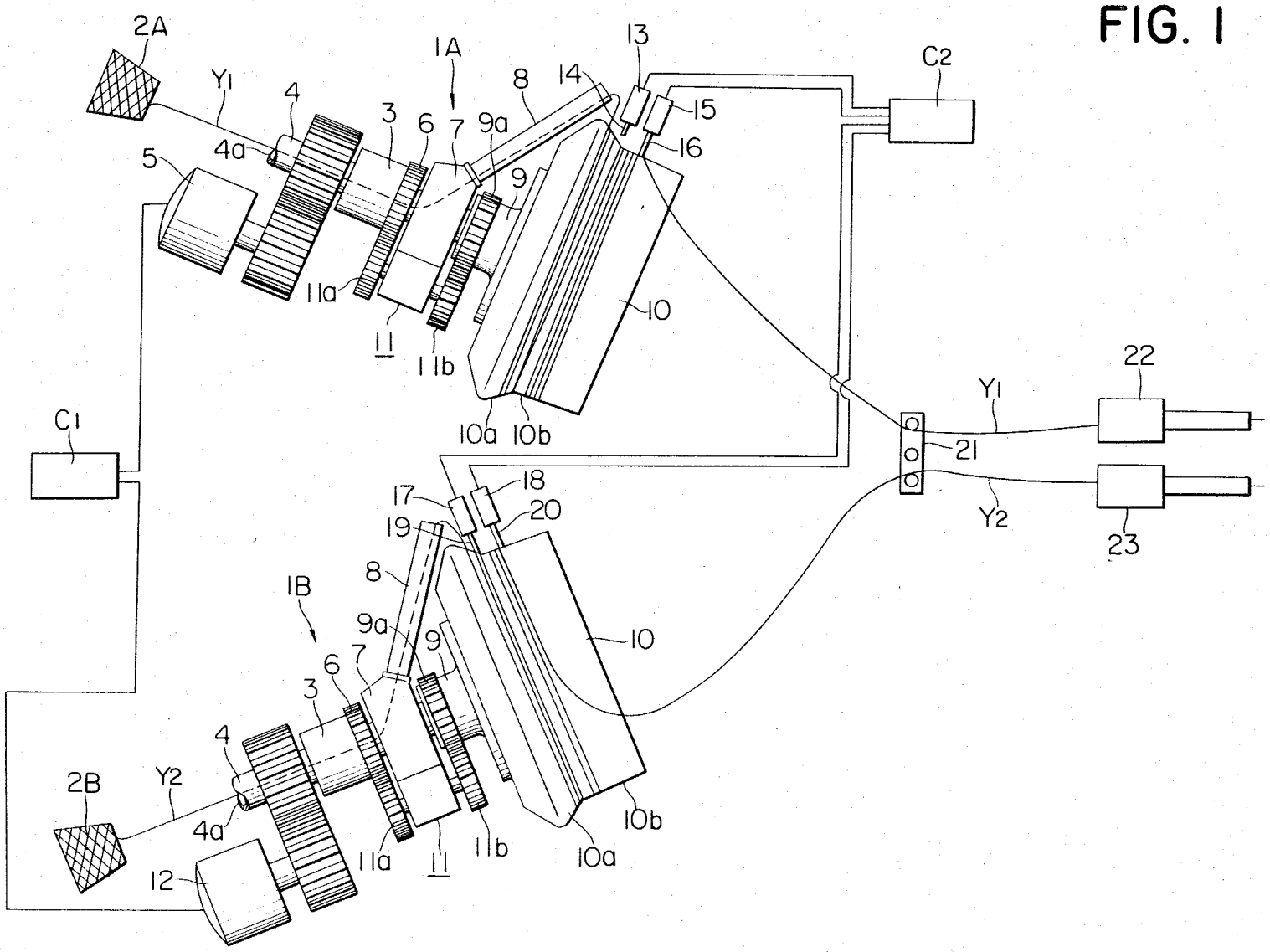
FIG. 1 is a diagrammatic plan view showing an embodiment of the weft inserting system according to the present invention.
Figure 2:
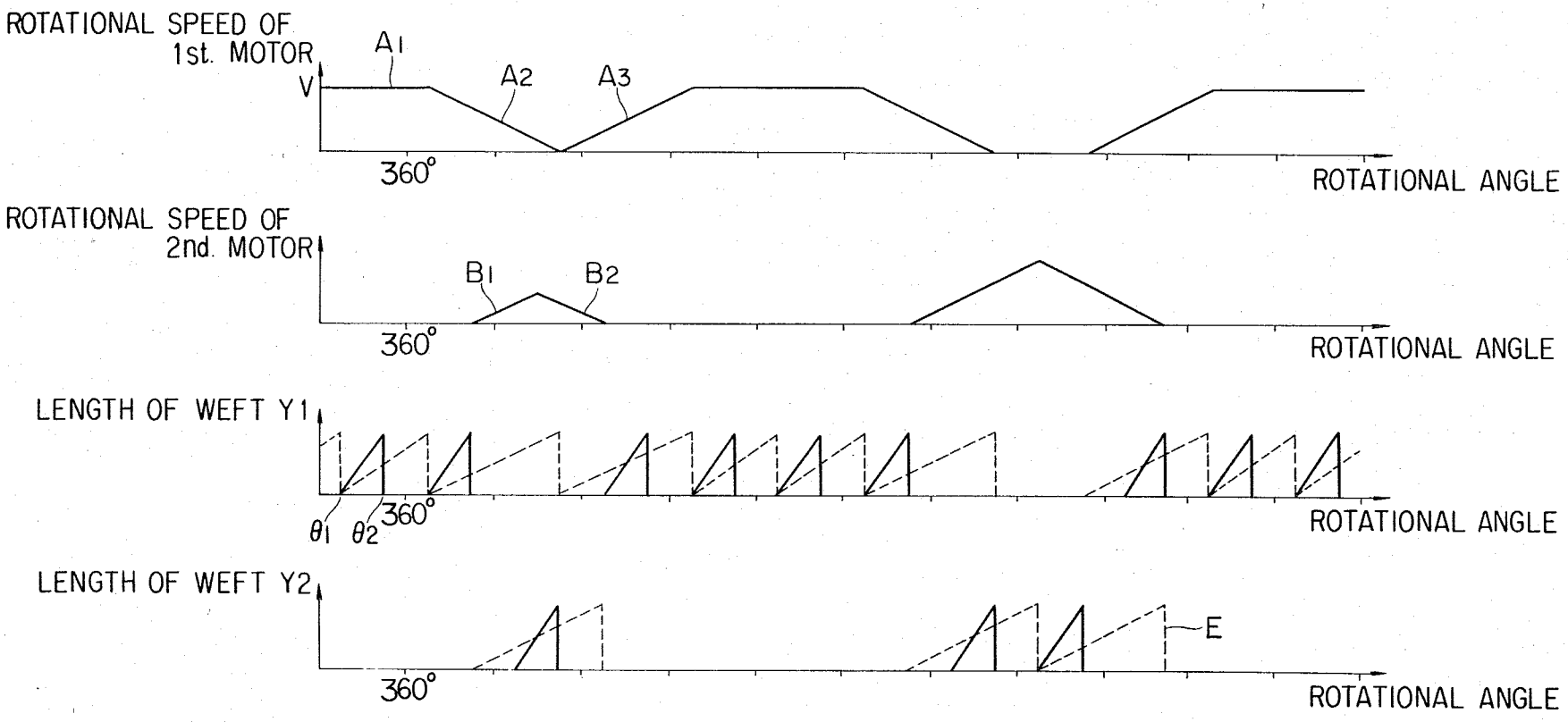
FIG. 2 is a chart showing the motor operation and weft yarn winding and laying down operation controlled under a specific weft yarn selection program.

Referring to FIGS. 1 and 2 for description of an embodiment of the present invention, the numeral 1A designates a weft yarn length measuring unit wherein a weft yarn Y1 delivered from a weft yarn supply unit 2A is wound and its length measured. The numeral 1B designates a weft yarn length measuring unit wherein a weft yarn Y2 delivered from a weft yarn supply unit 2B is wound and its length measured. The units 1A, 1B are similar in construction to each other.

Thus, referring only to the unit 1A, a rotary supporting shaft 4 having a yarn guide bore 4*a* for guiding the weft yarn Y1 is passed rotatably through a supporting member 3 secured to some stationary portion such as side frame of the loom. The shaft 4 is driven in rotation by a first electric motor 5 which is actuated by an operational command from a motor control unit C1, such as microcomputer, issuing command signals in accordance with a preset weft yarn selection program. On the front face (towards the weft yarn inserting side) of the supporting member 3, there is fixedly mounted a gear 6, to the front side of which is mounted a supporting element 7 secured in turn to the rotary supporting shaft 4. A yarn take-up or winding tube 8 is mounted to said supporting element 7 at an acute angle relative to shaft 4. The winding tube 8 has its hollow inside communicating with the yarn guide bore 4*a* and its foremost part resting above a first tapered peripheral surface 10*a* of a drum 10 to be described. A bracket 9 is mounted for relative rotation on the shaft 4 on the front side of the supporting member 7, and is formed with a gear 9*a*. The drum 10 having a yarn winding surface consisting of the first tapered peripheral surface 10*a* and a second tapered peripheral surface 10*b* and functioning as a yarn length measuring element is mounted on the shaft 4 at the front side of the bracket 9 and for relative rotation with shaft 4. A planetary gearing 11 is attached fixedly to the element 7 with an input planetary gear 11*a* meshing with gear 6 and an output planetary gear 11*b* meshing with gear 9*a*. The gear ratio of the gear 6 to the gear 11*a* is selected to be equal to that of the gear 9*a* to the gear 11*b*. Thus, as the first motor 5 is driven for setting the supporting shaft 4 in rotation, not only the yarn winding tube 8 but the planetary gearing 11 is rotated as one with the supporting shaft 4. The gears 11*a*, 11*b* are revolved about shaft 4 while meshing with gears 6, 9*a*, respectively, the drum 10 resting fixed without making any revolutions.

The rotary supporting shaft 4 of the yarn length measuring unit 1B is driven in rotation by a second electric motor 12 which is driven by an operational command from the motor control unit C1 issuing command signals in accordance with the weft yarn selection program.

A first weft yarn latching member 14 engageable with the first tapered peripheral surface 10*a* by operation of a solenoid 13 and a second weft yarn latching member 16 engageable with the second tapered peripheral surface 10*b* by operation of a solenoid 15 are mounted adjacent to the peripheral surface of the drum 10 of the unit 1A. Similarly, a first weft yarn latching member 19 and a second weft yarn latching member 20 engageable with a first tapered peripheral surface 10*a* and a second peripheral surface 10*b* by operation of solenoids 17, 18 respectively are provided on the unit 1B. These solenoids 13, 15, 17, 18 are operated by operating commands from a weft yarn latching member control unit C2, such as microcomputer, issuing command signals in accordance with a preset weft yarn selecting program.

The numeral 21 designates a guide member for guiding weft yarns Y1, Y2 in a known manner. The numerals 22, 23 designate main nozzles used for inserting the yarns Y1, Y2 separately in a known manner. During weft insertion, a selected one of these main nozzles is placed in readiness for inserting a length of weft yarn in accordance with a program for the control unit C2 or a weft yarn selection program for another control unit.

The main nozzles 22, 23 may be placed in readiness for inserting the weft yarn by a mechanism disclosed in the co-pending patent application entitled "weft inserting device for a jet loom" filed in the name of the present applicant (Japanese patent application No. 149738/1982). A plurality of solenoids of the weft inserting device may be energized selectively in accordance with the weft yarn selection program for the control unit, whereby a selected one of the main nozzles may be placed in readiness for inserting the weft yarn.

It is now assumed that the first motor 5 is driven in rotation in accordance with a preset weft selection program so that the yarn winding tube 8 is rotated about the drum 10 which remains stationary as mentioned hereinabove. The weft yarn supplied from the weft yarn supply unit 2A by way of the guide bore 4*a* and the winding tube 8 is wound on the surface 10*a* and its length measured, as the yarn is latched by the latching member 14 engaging with tapered surface 10*a* in accordance with the weft yarn selection program. Before a length of weft yarn Y1 equal to the preset length is wound on surface 10*a*, the latching member 14 is detached from surface 10*a* so that the yarn Y1 wound on the said surface 10*a* is shifted onto the second tapered surface 10*b* and latched by the second latching member 16 engaging with second tapered surface 10*b*. An additional length of the weft yarn Y1 is supplied onto the second tapered surface 10*b* while the first latching member 14 is detached from the second tapered surface in the manner described above. As the length of yarn Y1 equal to the preset length is wound on the second tapered surface 10*b*, the first latching member 14 is engaged with the first tapered surface 10*a* so that a length of weft yarn Y1 equal to a preset length is stored provisionally between first and second latching members 14, 16. Thereafter, as the second latching member 16 is detached from the second tapered surface 10*b* in accordance with the weft yarn selection program, the weft yarn Y1 is entrained in a fluid ejected from the main nozzle 22 resting at the weft inserting position in accordance with the weft yarn selection program so that the yarn is now inserted.

The weft yarn Y2 may be inserted similarly to the weft yarn Y1 in accordance with the weft yarn selection program.

In the aforementioned embodiment, a typical weft inserting operation in which the weft yarns Y1, Y2 are inserted in accordance with a weft inserting pattern or weft selection program such that the yarn Y1 is inserted twice, the yarn Y2 is inserted once, the yarn Y1 is inserted four times, the yarn Y2 is inserted twice and finally the yarn Y1 is inserted thrice, in this order, is now described by referring to FIG. 2. It should be noted that, in FIG. 2, the solid line represents the length of the reeled out yarn while the dotted line represents the length of the measured yarn.

It is now assumed that, under the operating command from motor control unit C1 issuing command signals in accordance with the weft yarn selection program, the first motor 5 is rotated, as indicated by a curve A1 in FIG. 2, at a preset speed V corresponding to the usual winding speed and determined by the width of the woven cloth and the number of weft inserting operations per unit time, and that a length of weft yarn Y1 corresponding to the preset length is latched by the second latching member 16 and stored on the second tapered surface 10*b*. This operative state corresponds to the rotational angle O1 of the movable loom parts, and the first latching member 14 is engaged at this time with the first tapered surface 10*a*. As the second latching member 16 is detached away from second latching member 10*b* in accordance with the weft yarn selection program, the preset length of weft yarn Y1 so far stored on the second tapered surface 10*b* is pulled out by the main nozzle 22 from drum 10 and inserted, with the inserting operation terminated at the rotational angle O2 of the movable loom parts. During this time interval, the first motor 5 is rotating at the speed V and the weft yarn Y1 is wound on first tapered surface 10*a* as it is latched by first latching member 14. After termination of the first weft insertion, the second latching member 16 is engaged with second tapered surface 10*b*, while the first latching member 14 is detached away from first tapered surface 10*b* so that the yarn Y1 so far wound on first tapered surface 10*b* is transferred to second tapered surface 10*b*. After this time, and until the start of the second weft inserting operation, weft yarn Y1 goes on to be wound on the second tapered surface 10*b* until the yarn length wound and stored is equal to the preset length. At the same time that the yarn Y1 thus wound and stored starts to be inserted, the first motor 5 is decelerated continuously as indicated at curve A2 and in accordance with the weft yarn selection program and comes to a stop upon termination of the third weft insertion.

During the time the first motor 5 is decelerated in the manner described above, the second weft insertion is carried out, while a length of weft yarn Y1 equal to the length of the yarn used for the fourth weft insertion is wound on drum 10. After termination of the second weft insertion, under the operating command of the motor control unit C1 issuing command signals in accordance with the weft insertion program, the second motor 12 is accelerated from standstill (as indicated by curve B1), decelerated (as indicated by curve B2) and stopped at the same time that the fourth weft insertion is started. When the third weft inserting operation is started, the second latching member 20 associated with the measuring unit 1B is detached away from the second tapered surface 10*b* so that a length of the yarn Y2 stored on the drum during the preceding storage cycle of the weft insertion pattern (this length corresponding to a height of the dotted line E indicative of the stored weft yarn Y2 in FIG. 2) is pulled out by main nozzle 23 from drum 10 and laid down. During the time that the second motor 12 is accelerated and decelerated in the manner described above, the first latching member 10 is controlled in accordance with the weft yarn selection program so that a length of the weft yarn Y2 to be used in the eighth weft insertion is wound on the drum 10.

During the time that the second motor 12 is accelerated and decelerated, that is, after completion of the second weft insertion and before the start of the fourth weft insertion, the second latching member 16 of the measuring unit 1A is engaged with the second tapered surface 10*b*. This latching member 16 is detached away from the second tapered surface 10 with start of the fourth weft insertion to allow a preset length of yarn Y1 to be pulled from drum 10 and laid down by main nozzle 22. The first motor 5, halted upon termination of the third weft insertion, is restarted and accelerated (as shown by curve A3) at the instant it is halted so that the constant speed V is again reached at the starting time of the fifth weft insertion. During the period of acceleration of the motor 5, a length of weft yarn to be used in the fifth weft insertion is wound on drum 10.

In this manner, the motors 5, 12, the first latching members 14, 19 and the second latching members 16, 20 are controlled by control units C1, C2 so that the fifth and the following weft inserting operations are carried out as set on the selection program.

According to the present invention, the weft winding speed can be set freely to zero speed, constant speed, acceleration or deceleration in accordance with the selection program, in a manner distinct from the conventional weft yarn measuring device in which the weft yarn is wound continuously on the drum. In addition, the operation of the weft latching mechanism may also be controlled in accordance with the selection program in such a manner that the number of weft yarn latching members need not be increased even in instances where the weft yarn supplied from one supply unit is inserted a number of times in succession. Hence, any desired weft yarn pattern may be selected freely by properly formulating the selection program and without the necessity of changing mechanical parts with the exception of increasing or decreasing the number of weft yarn length measuring units as a consequence of increasing or decreasing the number of weft yarn supply units.

Figure 3:
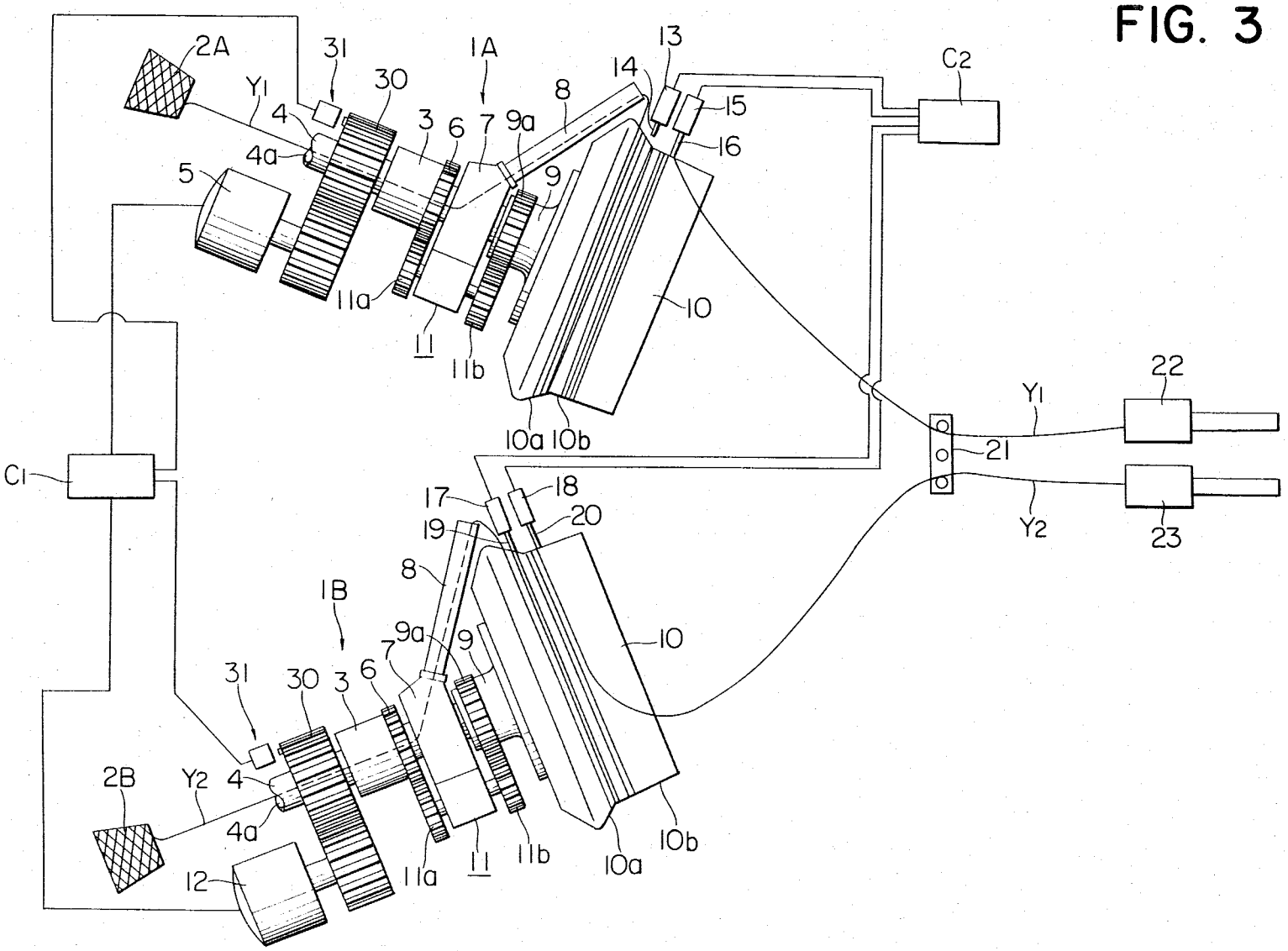
FIGS. 3 and 4 are a plan view and a chart similar to FIGS. 1 and 2 respectively and showing a modified embodiment of the invention.

FIG. 3 shows a modified embodiment according to which a sensor for sensing the number of times the weft yarn is wound on the drum is associated with each weft yarn length measuring unit. Referring to the measuring unit 1A, a gear 30 is secured to the rotary supporting shaft 4 at the back of the supporting member 3 (or to the left side thereof in the Figure) and the shaft is rotated by the first motor 5 operatively connected to the gear 30. The aforementioned sensor for sensing the number of revolutions of the gear or the number of times the yarn Y1 is wound on the drum, such as proximity switch 31, is mounted close to the gear 30 for supplying output signals to the motor control unit C1 issuing operating commands to the first motor 5 and to the second motor 12 to be later described. When the output signal is supplied from proximity switch 31 to the control unit C1, an ensuing speed curve for the first motor 5 is computed in the unit C1 based on time left until termination of measurement of preset yarn length, the rotational speed of the first motor 5 prevailing at the time the sensor signal is supplied to the unit C1 and the programmed speed of the first motor 5 prevailing upon termination of yarn length measurement. A command signal is issued to the first motor 5 based on the result of the operation performed in the unit C1.

Figure 4:
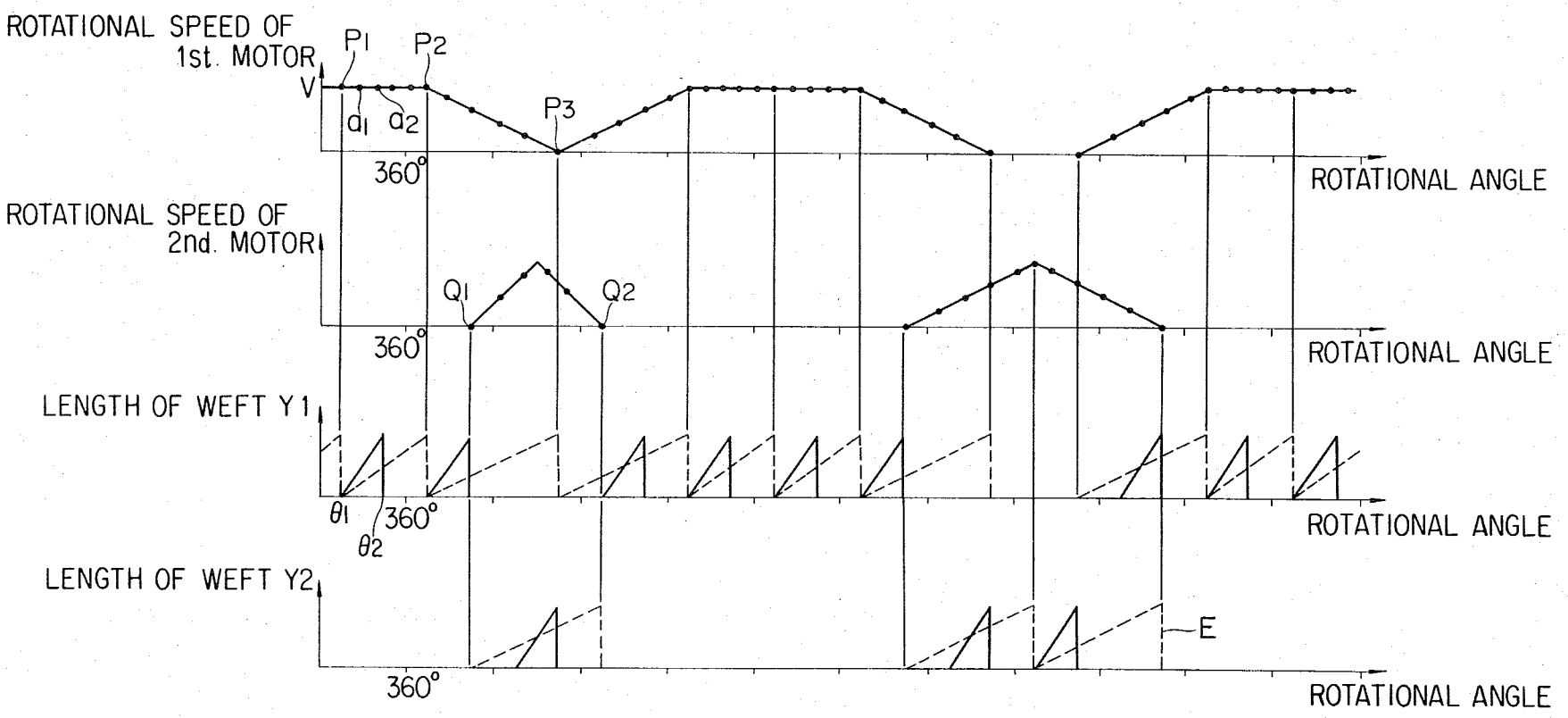

In the aforementioned embodiment provided with sensing means for sensing the number of turns of the wound yarn, a typical weft inserting operation in which the weft yarns Y1, Y2 are inserted in accordance with a weft inserting pattern such that the yarn Y1 is inserted twice, the yarn Y2 is inserted once, the yarn Y1 is inserted four times, the yarn Y2 is inserted twice and finally the yarn Y1 is inserted thrice, in this order, is now described by referring to FIG. 4. The operation already described with reference to FIG. 2 is not described for avoiding redundancy.

Referring to a lower part of FIG. 4 indicating the length of the weft yarn on the ordinate, the measured yarn length is indicated by the dotted line and represented by a product $V.t_o$, where $t_o$ indicates the time required for the movable loom parts to complete one revolution and V the preset speed for the motor 5 or 12 determined by the cloth width and the number of times the weft yarn is inserted within unit time. The aforementioned yarn length is the length of the yarn Y1 or Y2 wound five times about the drum 10. Dots on the curves indicating the rotational speeds of the first and second motors 5, 12 represent the time points when the output signals from the switch 31 are supplied to the control unit C1.

The rotational speed of the first motor 5 is programmed to be equal to the preset speed V at the time P1 when the measurement is started and at the time P2 when the measurement is terminated. For the measuring interval P1–P2 (equal to time interval $t_o$), the speed of the motor 5 is controlled in the following manner.

The motor 5 is driven at the preset speed V at time P1, as described above. This rotational speed is maintained by the command from control unit C1 until the next output signal is supplied from the proximity switch 31, that is, until the gear 30 makes one complete revolution and the yarn Y1 is wound once around the drum 10. This time juncture is shown at a1 in FIG. 4. It is now supposed that the first motor 5 is rotated at the preset speed V without experiencing speed changes. At time a1 that the sensor signal is supplied from switch 31, the control unit C1 computes the ensuing curve for the motor 5 to be constant and equal to V, based on time left until the end of the length measurement P2 or $4/5\ t_o$, the actual speed V of the motor 5 at time a1 and the programmed speed of the motor 5 at time P2, and issues a command speed V to the motor 5 based on the result of the operation. It is supposed further that the motor 5 goes on rotating at speed V without experiencing speed changes. Then, at time a2 that the sensor signal is supplied from switch 31, the unit C1 computes the ensuing speed for the motor 5 to be constant and equal to V, based on the time left until the end of measurement P2 or $3/5\ t_o$, the actual speed V of the motor 5 at time a2 and the programmed speed V for the motor 5 at time P2, and issues a command speed V for the motor 5 based on the result of the operation.

When the speed of the motor 5 is decreased after time P1, the output signal from proximity switch 31 is supplied to the control unit C1 at a time later than time a1 when the output signal from the switch 31 should be supplied to the unit. Therefore, at the time a1′ when the output signal is supplied to the control unit C1, the unit computes an ensuing speed curve for the motor 5, based on the time to elapse until termination of measurement P2 which is less than 4/5 $t_o$, the actual speed of the first motor 5 at time a1′ which is less than V and the programmed speed V of the first motor 5 at time P2, and issues a speed increase command to the first motor 5.

On the contrary, when the speed of the first motor 5 should be increased since start of measurement P, the output signal of the switch 31 is supplied to the control unit C1 at an earlier time than the entry of the output signal at a1. Therefore, at the time a1″ when the output signal is supplied to the control unit C1, the unit C1 computes an ensuing speed curve for the first motor 5, based on the time left until termination of measurement at P2 which is longer than 4/5 $t_o$, the actual speed of the first motor 5 at time a1″ which is more than V and the programmed speed V of the first motor 5 at time P2, and issues a command for a speed decrease to the first motor 5.

Such speed control is effected each time the output signal is supplied from proximity switch 31 to the control unit C1 so that the preset length of weft yarn Y1 is wound on drum 10 at time P2 and the motor speed at this time is equal to the programmed speed V.

The first motor 5 is continuously decelerated at the same time that the weft yarn Y1 whose length has been measured during the time period P1–P2 starts to be laid down, and is brought to a stop upon termination of the third weft inserting operation.

The rotational speed of the first motor 5 for this time interval P2–P3 is set to be equal to V at the start of measurement at P2 and zero at the end of measurement at P3 in FIG. 4. Speed control for the first motor 5 for the period P2–P3 (equal to time 3/2 $t_o$ and corresponding to one and a half revolutions of the movable loom parts) is effected similarly to speed control for the period P1–P2 described above.

Thus, at time P2 when the output signal is supplied from switch 31 to the control unit C1, the unit C1 computes an ensuing speed curve for the first motor 5, based on the time left until P3, which is equal to 3/2 $t_o$, the actual speed of the first motor 5 at time P2, and the programmed speed for the motor 5 at time P3, which is zero, and issues a command signal to the motor 5 based on the result of the operation. The unit C1 performs similar speed control for each entry of the output signal from the swtich 31.

During the period P2–P3, the second weft inserting operation is performed, while a length of weft yarn Y1 to be laid down at the fourth inserting operation is wound about drum 10. Upon termination of the second weft insertion, the second motor 12 is accelerated from standstill under control of the control unit C1. During the measurement period Q1–Q2 in FIG. 4, the motor 12 is switched from acceleration to deceleration and stopped at the start of the fourth weft inserting operation under control of the control unit C1.

During this period Q1–Q2, speed control of the second motor 12 is effected by the unit C1 similarly to that of the first motor 5, based on the output signals from the proximity switch 31 associated with the yarn length measuring unit 1B.

Upon start of the third weft inserting operation, the second latching member 20 associated with the second unit 1B is detached from the second tapered surface 10*b*, and a length of weft yarn Y2 wound on drum 10 in the course of the preceding storage cycle of the weft inserting pattern is pulled out by main nozzle 23 from drum 10 to be laid down. This length is equal to the preset length and corresponds to a height E of the dotted line curve in the lower portion of FIG. 4. During the period Q1–Q2, the first latching member 19 is controlled in accordance with the weft yarn selection program for winding on the drum 10 a length of weft yarn Y2 to be laid down in the eighth weft inserting operation. During the period Q1–Q2, the second latching member 16 associated with the unit 1A is engaged with second tapered surface 10*b*. At the start time of the fourth weft inserting operation, the second latching member 16 is disengaged from the second tapered surface 10*b* so that a length of weft yarn equal to the preset length is pulled out by main nozzle 22 from drum 10 and laid down. The first motor 5, which has been halted upon termination of the third weft inserting operation, is accelerated at the instant it is stopped so that the set speed V is attained at the start of the fifth weft insertion. During this period of acceleration of the first motor, a length of weft yarn Y1 to be laid down in the fifth inserting operation is wound on drum 10.

The first and second motors 5, 12, the first latching members 14, 19 and the second latching members 16, 20 may be controlled in this manner by control units C1, C2 so that the fifth and the subsequent weft inserting operations may be performed as set on the weft yarn selection program. In addition, since the speed of first and second motors 5, 12 is controlled each time the output signals are supplied to the control unit C1 from respective proximity switches 31, weft yarn lengths may be measured accurately without causing any appreciable fluctuations.

The present invention is not limited to the above embodiments but may comprise a number of modifications. For example, the yarn latching members may be protruded from and receded into the inside of drum 10 by the operation of associated solenoids. The yarn winding tube 8 may be fixed and the drum 10 rotated, three or more yarn supply units and equally three or more yarn length measuring units may be provided. In addition, only one, three or more yarn latching members may be provided within the scope of the present invention. The rotational speed of the motors 5, 12 may be preset on the control program and the current speed of the motors 5, 12 compared with the programmed speed at each instant the output signal is supplied from the proximity switches 31 for controlling the motor speeds. In addition, the present invention may be embodied in an apparatus of the type in which the drum 10 is rotated and the winding tube 8 is stationary.

From the foregoing, it is appreciated that the arrangement according to the present invention provides for precisely controlling the winding speed of the weft yarn on two or more drums, the length of the wound yarn and the operation of the weft yarn latching means in accordance with the preset weft yarn selection program, thus enabling the weft yarn or yarns to be inserted in any desired patterns without the necessity of changing mechanical parts only on condition that the control program is formulated correspondingly. Furthermore, in addition to controlling the weft yarn winding speed and the operation of the weft yarn latching members, as described above, the weft yarn winding speed on the respective drums may be controlled wherever the output signals are issued from sensing means adapted for sensing the number of turns of the weft yarn. In this case, it is possible to compensate for any deviations of the motor speed from its programmed speed caused by resistance to rotation or unstable braking performance, thus assuring higher precision in measurement of weft yarn length.

What is claimed is:

1. An apparatus for measuring the length of weft yarn for a loom, comprising at least two weft yarn length measurement elements respectively associated with an equal number of weft yarn supply means and providing weft yarn winding surfaces, an equal number of intermittently operating motor means respectively associated with said measurement elements for winding the weft yarns on said winding surfaces, and respective weft yarn latching means associated with said winding surfaces of each said weft yarn supply means for controlling the measured amounts of weft yarn for successive one-pick lengths wound on each of said winding surfaces and the transfer of the wound weft yarn in the weft inserting direction, characterized in that control means are provided for controlling the respective rotational speeds of said motor means and the respective operations of said weft yarn latching means in accordance with a preset weft yarn selection program stored in said control means, whereby said one-pick lengths are measured and wound on said surfaces despite variations in the timing of said transfers of the wound weft yarn in accordance with said yarn selection program.

2. The apparatus as claimed in claim 1, characterized in that each said yarn length measurement element is a drum mounted for relative rotation on a rotary supporting shaft driven in rotation by its said associated motor means.

3. The apparatus as claimed in claim 2, characterized in that each said weft yarn latching means comprises a pair of solenoids mounted close to said yarn winding surfaces of each said drum and operated by command signals from said control means, and a pair of weft yarn latching elements respectively associated with said solenoids and mounted for movement to project from their associated solenoids into engagement with an associated one of said winding surfaces upon energization of the solenoid.

4. The apparatus as claimed in claim 1, characterized in that means for sensing the number of times the weft yarn is wound on each said measurement element is associated with each said element, and in that said control means delivers speed commands to respective ones of said motor means each time output signals are supplied to the control means from said sensing means.

5. The apparatus as claimed in claim 4, characterized in that said speed commands to said motor means are made based on the result of an operation performed by said control means controlling the rotational speeds of respective ones of said motor means, said operation comprising deriving ensuing speed curves for respective ones of said motor means from the time left until termination of measurement of a weft yarn length to be inserted in the impending weft insertion, current speeds of the respective ones of said motor means prevailing at the time of sensor signal entry and program speeds of the respective motor means prevailing at the end of measurement of said weft yarn length.

6. The apparatus as claimed in claim 4, characterized in that said speed commands to the respective ones of said motor means at the time of signal entry from respective ones of said sensor means are made by said control means controlling rotational speeds of respective ones of said motor means based on the result of comparisons between programmed speeds and actual speeds of respective ones of said motor means prevailing at each instant of output signal delivery from said sensor means to said control means.

7. The apparatus as claimed in claim 3, characterized in that means for sensing the number of times the weft yarn is wound on each said measurement element is associated with each said element, and in that said control means delivers speed commands to respective ones of said motor means each time output signals are supplied to the control means from said sensing means.

8. The apparatus as claimed in claim 7, characterized in that said speed commands to said motor means are made based on the result of an operation performed by said control means controlling the rotational speeds of respective ones of said motor means, said operation comprising deriving ensuing speed curves for respective ones of said motor means from the time left until termination of measurement of a weft yarn length to be inserted in the impending weft insertion, current speeds of the respective ones of said motor means prevailing at the time of sensor signal entry and program speeds of the respective motor means prevailing at the end of measurement of said weft yarn length.

9. The apparatus as claimed in claim 7, characterized in that said speed commands to the respective ones of said motor means at the time of signal entry from respective ones of said sensor means are made by said control means controlling rotational speeds of respective ones of said motor means based on the result of comparisons between programmed speeds and actual speeds of respective ones of said motor means prevailing at each instant of output signal delivery from said sensor means to said control means.

* * * * *